United States Patent [19]

Yamashita et al.

[11] Patent Number: 4,695,059

[45] Date of Patent: Sep. 22, 1987

[54] HIT INDICATING SYSTEM IN TOWED TARGET FOR AERIAL FIRING PRACTICE

[75] Inventors: Masatoshi Yamashita; Norio Tsunoda, both of Utsunomiya, Japan

[73] Assignee: Fuji Jukogyo Kabushiki Kaisha, Tokyo, Japan

[21] Appl. No.: 645,125

[22] Filed: Aug. 28, 1984

[51] Int. Cl.[4] ..... F41J 5/04; F41J 9/10

[52] U.S. Cl. ..... 273/360; 273/363; 273/380; 273/371; 434/14

[58] Field of Search ..... 273/360, 361, 363, 371, 273/373, 374, 379, 384, 31, 378, 380; 434/11, 14, 23

[56] References Cited

U.S. PATENT DOCUMENTS 3,065,967 11/1962 Humphrey et al. ..... 273/360
3,401,939 9/1968 La Mura ..... 273/373
3,499,651 3/1970 Hubbard ..... 273/373
4,240,640 12/1980 La Mura ..... 273/373
4,365,805 12/1982 Levine ..... 273/31

*Primary Examiner*—Richard C. Pinkham
*Assistant Examiner*—MaryAnn Stoll Lastova
*Attorney, Agent, or Firm*—Martin A. Farber

[57] ABSTRACT

A hit indicating system in an aerial firing practice target to be towed comprises parallel connected resistance circuits the combined resistance of which is varied when any of the circuits is cut by a bullet, and this variation activates an ignition control unit comprising a differentiation circuit, a logic circuit, an output circuit, and optionally, a waveform shaping circuit, to transmit signals causing signal tubes to operate in sequence to emit flares or smoke preferably of significantly different hues indicating sequential hits to enable visual observation from aircraft at relatively remote positions.

1 Claim, 9 Drawing Figures

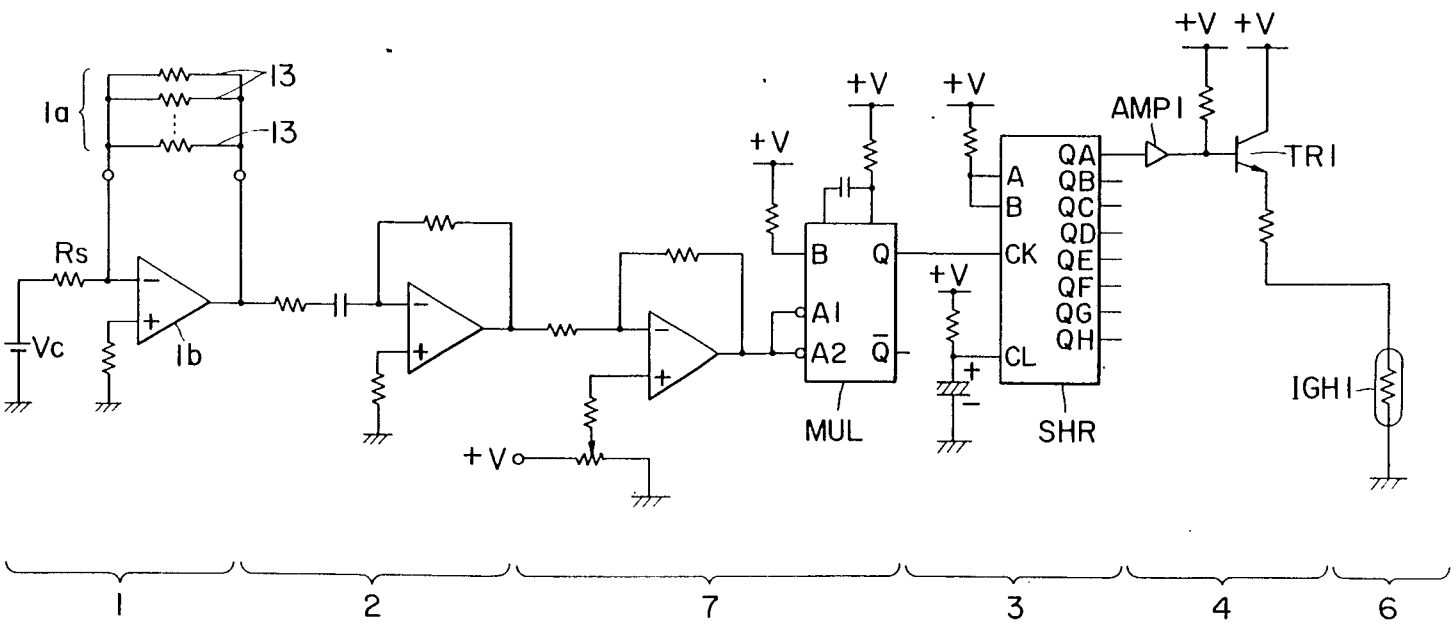
13
13
Ia
Rs
Vc
Ib
+V
+V
+V

HIT INDICATING SYSTEM IN TOWED TARGET FOR AERIAL FIRING PRACTICE

BACKGROUND OF THE INVENTION

This invention relates to targets which are towed by aircraft for aerial machine-gun firing practice and more particularly to a system, in such a target, for indicating hits by bullets fired during such firing practice.

In the case of aerial firing practice from an aircraft with high-priced missiles or the like. a high-priced miss distance indicator (MDI) such as a pulse Doppler radar system which is divisionally installed in the target and the training aircraft or the target towing aircraft is used as a system for evaluating the results of such firing practice. In the case of firing practice with relatively inexpensive machine-gun ammunition, the target itself is ordinarily disposable and is discarded after use, and an MDI is unsuitable for such a target. In the present state of firing practice with such targets, another trainer aircraft approaches a target after firing practice and a person on this aircraft visually evaluates the hit result. This method, however, is not only undesirable with respect to the effectiveness of training of the pilot or machine gunner but is also uneconomical with respect to the time expended and fuel consumed.

With the aim of overcoming such drawbacks, targets equipped with hit indicating systems which indicate bullet hits by emitting light have been developed and publicly disclosed in specifications such as the following: Japanese Utility Model Laid Open Publication No. 124900/1974, Utility Model Laid Open Publication No. 131798/1974, Utility Model Laid Open Publication No. 27700/1975, and Utility Model Laid Open Publication No. 93298/1977.

In each of these known systems, one bullet hit sensor section, one control section, and one indicating section are provided in one-to-one-to-one correspondence to consitiute one indicating device set. For this reason, one set of the indicating device can accomplish the indication of hit by only a single bullet. Accordingly, in the case where this system is to be used in an aerial towed target, a large number of the one-to-one-to-one sets of the devices must be used. This requirement increases the number of component parts and the cost. In addition, the probability of effective operation of all of the numerous control sections and indicating sections becomes very low, and much waste occurs, whereby these systems cannot be readily reduced to practice in the present state of the art.

SUMMARY OF THE INVENTION

It is an object of this invention to overcome the above-described problems encountered in the prior art by providing a hit indicating system in a towed target, which system has the desirable features of high detection resolution, light weight, and low price.

According to this invention, briefly summarized, there is provided, in a target for firing practice to be towed by an aircraft or the like, a hit indicating system comprising: a bullet pierce detection section installed over parts of the target where bullets are expected to hit and comprising a plurality of resistance circuits connected in parallel respectively constituting bullet pierce detection elements; able to be broken when pierced by a bullet a differentiation circuit responsive to variations in the combined resistance value of the bullet pierce detection section for generating pulse signals; an indicating unit comprising a plurality of indicating elements; a logic circuit for generating outputs for causing said indicating elements to operate sequentially on the basis of the pulse signals of the differentiation circuit; and an electric power source for supplying electric power to the bullet pierce detection section, the differentiation circuit and the logic circuit; the bullet pierce detection section, the differentiation circuit, the indicating unit, the logic circuit and the power source being installed on board the target; and the bullet pierce detection section includes two bus conductors connecting opposite ends respectively of the resistance circuits in parallel, the bus conductors have opposite ends forming two pairs of terminals connected to the differentiation circuit, whereby bullet pierce detection of the system is unaffected by a single break at one part of the bus conductors, respectively, and bullet pierce detectin of the system is affected by a double break at two parts of the bus conductors, respectively, only by failure of the resistance circuits between the double break.

The nature, utility, and further features of this invention will be more clearly apparent from the following detailed description with respect to preferred embodiments of the invention when read in conjunction with the accompanying drawings, briefly described below.

BRIEF DESCRIPTION OF THE DRAWINGS

In the drawings:

FIG. 6 is a circuit diagram showing in detail a specific example of the system of FIG. 4;

DETAILED DESCRIPTION OF THE INVENTION

Figure 1:
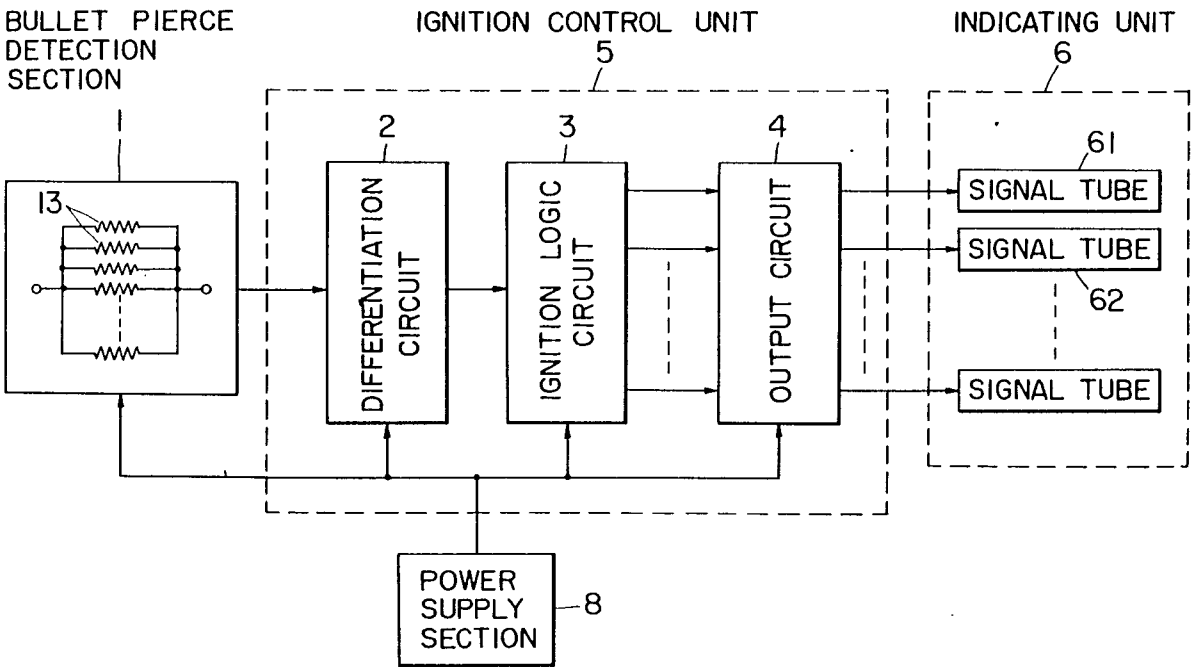
FIG. 1 is a block diagram indicating the essential organization of one example of the hit indicating system in an aerial towed target according to this invention.
Figure 2A:
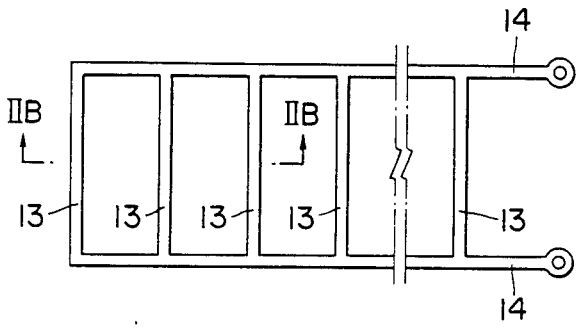
FIG. 2A is a foreshortened planar view showing the pattern of wiring of a bullet pierce detection section in the system of the invention.
Figure 2B:
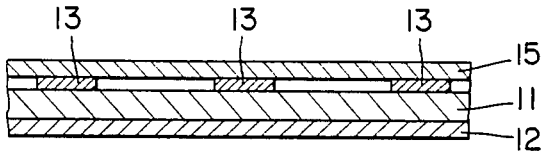
FIG. 2B is a relatively enlarged section taken along the plane indicated by line IIB—IIB in FIG. 2A.

Referring to FIG. 1 illustrating one example of a hit-indicating system of a towed target constituting an embodiment of this invention, the system has a bullet pierce detection section 1 (hereinafter referred to as the "detection section" for brevity) which has a great number of resistances connected in parallel, and which is connected to a power supply section 8. The detection section 1, for example, as shown in FIGS. 2A and 2B, comprises: a synthetic resin film 11 constituting an electrically insulative film; a pressure-sensitive adhesive layer 12 formed on the rear or back surface of the plastic film 11; a resistance wiring layer disposed on the opposite or front surface of the plastic film 11 and comprising in ladder formation a large number of parallel resistance wires 13 and bus conductors 14 respectively connecting opposite terminals of the resistance wires 13; and an electrically insulative film 15 laminated over the surface of the resistance wiring layer opposite from the surface thereof in contact with the plastic film 11.

Figure 3:
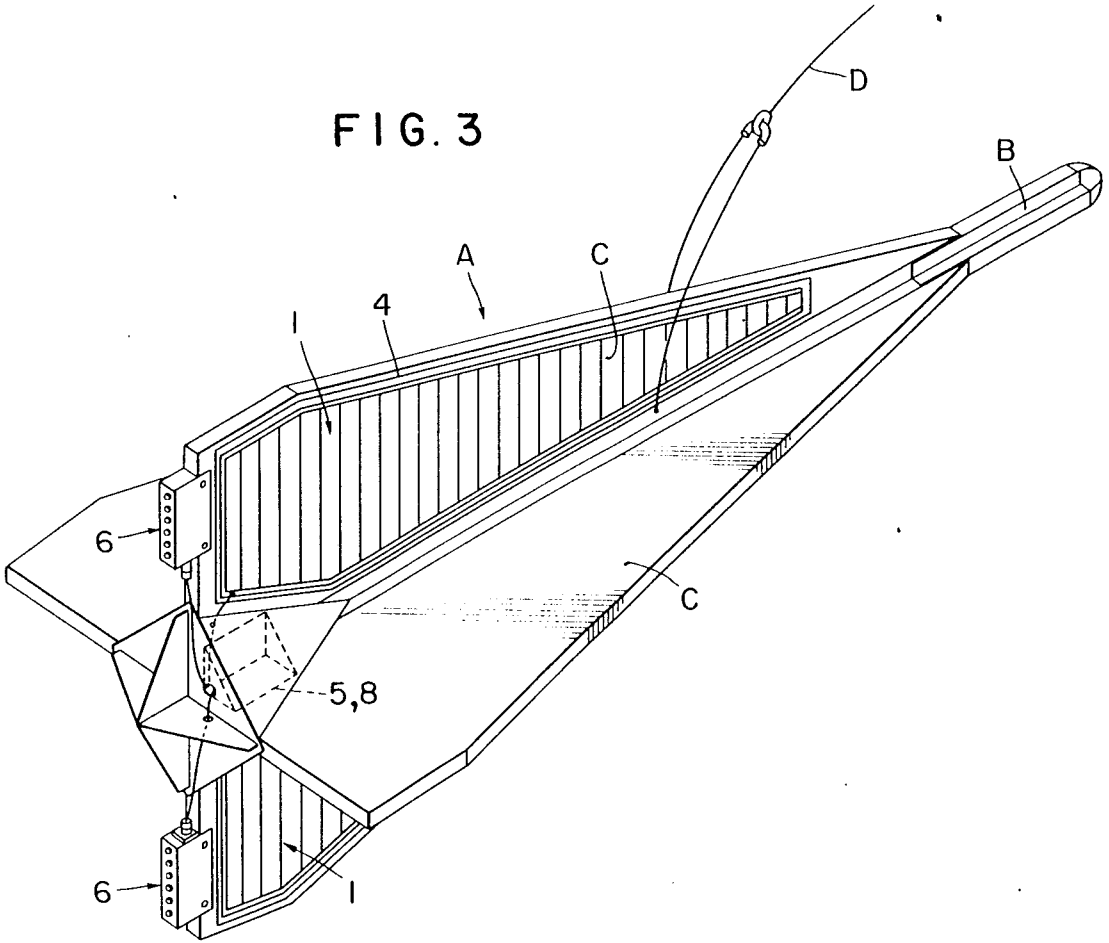
FIG. 3 is a perspective view of an aerial towed target in which the hit indicating system shown in FIG. 1 is installed.

In the resistance wiring layer, the resistances 13 are formed as parallel lines by the use of an electroconductive paint having a high resistivity with spacing between adjacent lines less than the diameter of the bullet holes passing through the detection section 1. The resistance wiring layer of this ladder pattern of the resistance wires 13 and the bus conductors 14 covers a required area, that is, parts of the towed target which are expected to be hit by bullets. In the case of a target A comprising a shaft-like fuselage or body B and fins or wings C as shown in FIG. 3, the detection section 1 is secured to the entire area or portions of the wings C constituting parts of high probability of being hit by bullets. The parallel-connection circuit of the resistance wires 13 is incorporated in circuitry formed to produce a voltage output whose magnitude varies when the synthetic or combined resistance of the entire parallel circuit of the wires 13 varies.

Referring again to FIG. 1, the output side of the detection section 1 is connected to the input side of a differentiation circuit 2. Each time the output voltage of the detection section 1 changes, a pulse signal of spike form is generated by this differentiation circuit 2 and introduced as input into an ignition logical circuit 3.

The ignition logic circuit 3 generates a signal in which, out of a plurality of outputs, only one is of a "high" level, i.e., logical "1" level at any instant. Each time a pulse signal from the differentiation circuit is introduced as input into this ignition logic circuit 3, it causes an output of high signal level to shift, thus causing such outputs to shift successively one at a time. This ignition logic circuit comprises, for example, a shift register. The output signals of this ignition logic circuit 3 are amplified to specific levels in an output circuit 4 and then cause combustion over a certain period of time successively in respective signal tubes 61, 62, . . . , for example, of an indicating unit 6 thereby to cause these signal tubes 61, 62, . . . to emit a flare or smoke in response to their respective input signals. Thus, each time the differentiation circuit 2 generates one pulse signal, the ignition logic circuit 3 causes a corresponding different signal tube to operate. It is preferable, further, that the flares or smoke of the signal tubes 61, 62, . . . be of respectively different hues.

The differentiation circuit 2, the ignition logic circuit 3, and the output circuit 4, and other components constitute an ignition control unit 5, which, together with the power supply 8, are mounted at the stern or tail part of the body B of the target A as shown in FIG. 3. The indicating unit 6 is mounted, for example, on the trailing edge of the wing C onto which the corresponding detection section 1 is secured.

The target A shown in FIG. 3 is towed by an aircraft by means of a tow line or wire rope D.

The hit-indicating system of the above-described organization and installation in a towed target according to this invention operates in the following manner.

When a bullet fired from a firing practice training aircraft strikes a detection section 1 secured to a wing surface of the towed target A, a certain circuit among the numerous circuits formed by the resistance wires 133 in parallel of that detection section 1 is broken. Consequently, the combined resistance value of the parallel circuit of the wires 13 varies, and the output voltage of the detection section 1 varies. Then, in response to this output voltage variation, the differentiation circuit 2 generates a pulse signal of spike form which, through the ignition logic circuit 3 and the output circuit 4, ignites the first signal tube 61 of the indicating unit 6. This first signal tube 61 thus emits a flare or smoke, whereby it can be promptly verified visually from the remote training aircraft that a hit has been made.

As a succession of bullets hit the target and cut, two, three, . . . of the numerous resistance wires 13 of the detection section 1, the output voltage of the detection section 1 varies each time a resistance wire 13 is cut, and the differentiation circuit 2 generates a pulse signal in response to each variation of this output voltage. Accordingly, the ignition logic circuit 3 produces output signals according to the bullet impact sequence thereby to successively operate the second, third, . . . signal tubes respectively.

By arranging the hues of the flares of smoke of all signal tubes of the indicating unit 6 so that they differ for each signal tube as mentioned hereinbefore, not only is the confirmation of hits possible, but, by the hues, the sequential number of each hit and the number of the remaining signal tubes can be easily confirmed visually from a remote position.

According to this invention as described above, the cutting of each bullet pierce detecting units comprising a great number of resistance wires 13 can be positively detected and indicated by a single ignition control unit 5. Accordingly, the bullet pierce detection capability and detection resolution are greatly improved with the use of a light and relatively inexpensive system.

Theoretically, by providing the same number of signal tubes as the number of bullet pierce detecting elements in one detection section 1, it is possible to detect and indicate piercing of bullets until all of the bulles pierce detecting elements have been cut. Actually, however, the probability of all detecting elements being cut is very low. Accordingly, a practically reasonable number (for example, of the order of 6 to 20) of signal tubes is suitable in actual practice.

Figure 4:
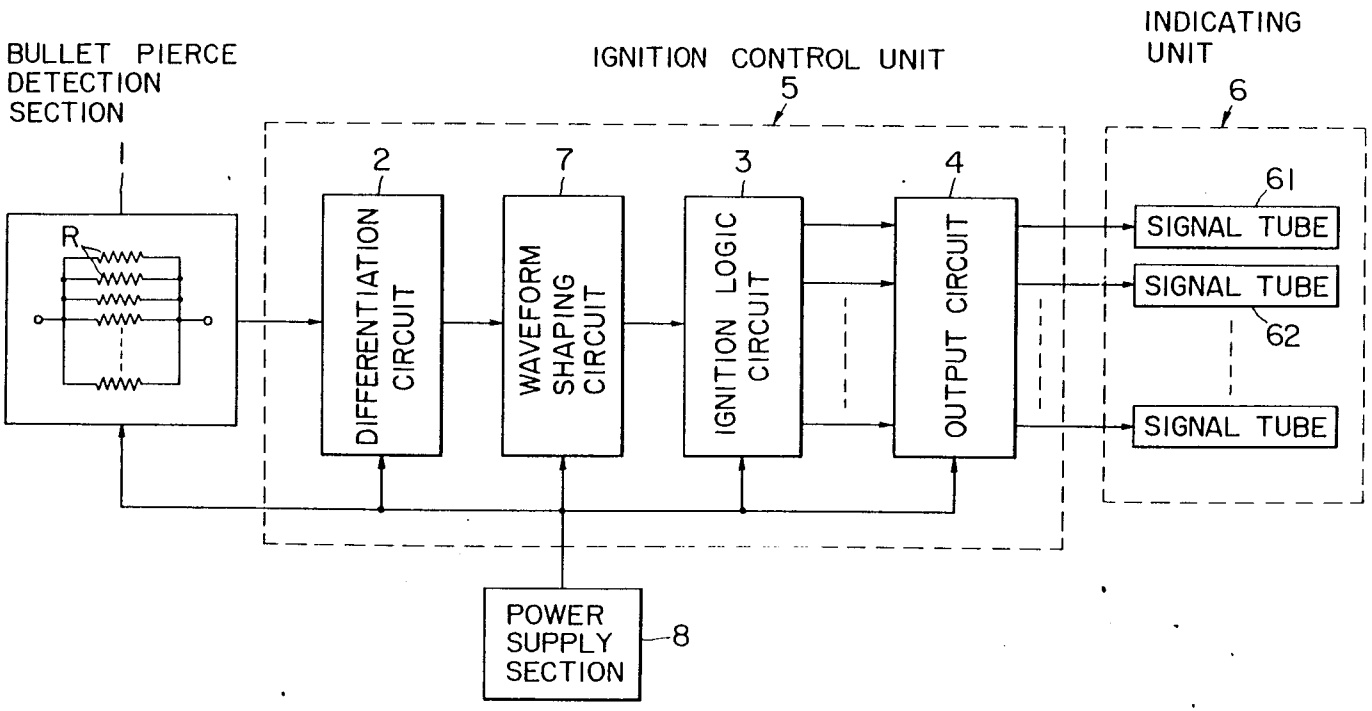
FIG. 4 is a block diagram indicating the essential organization of another example of the hit indicating system of the invention.

A second embodiment of this invention as shown in FIG. 4 differs from that described above in conjunction with FIG. 1 only in that a waveform shaping circuit 7 is installed between the differentiation circuit 2 and the ignition logic circuit 3 of the ignition control unit 5. In all other features of organization, this second example of the system is the same as the first example. Those parts in the system shown in FIG. 4 which are the same as corresponding parts in the system of FIG. 1 are designated by the same reference numerals.

In the case where machine-gun target practice is being carried out from an aircraft, a large number of rounds of bullets are fired in some instances in a continuous burst during a very short time period from a somewhat remote point and, within a very short period, hit a detection section of the target with a shotgun-like pattern. In such a case, it is meaningless and wasteful to operate signal tubes of a number corresponding to the number of bullets which have thus hit.

Accordingly, as shown in the example of FIG. 4, the waveform shaping circuit 7 is interposed between the differentiation circuit 2 and the ignition logic circuit 3 and utilized to render a plurality of piercing bullets having slight time differences into a single bullet hit and to indicate it as such.

Figure 5:
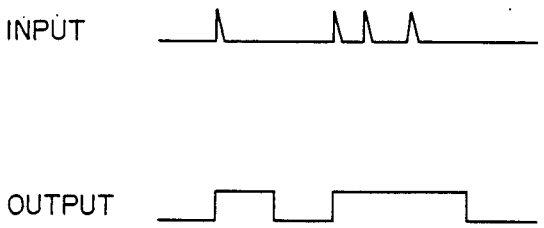
FIG. 5 are diagrams indicating the operation of a waveform shaping circuit in the system illustrated in FIG. 4.

More specifically, the waveform shaping circuit 7 is so adapted that, upon receiving one spike-form pulse signal from the differentiation circuit 2, it produces as output a sustained signal of a specific time width which is somewhat long as indicated in FIG. 5. The waveform shaping circuit 7 is further so adapted that, while it is outputing this sustained signal, it does not produce a new output even when a succeeding spike-form signal is received thereby as input from the differentiation circuit 2. A waveform shaping circuit of this character can be constituted, for example, by a monostable multivibrator.

Accordingly, the impact of a plurality of bullets within a set time width of the pulse wave of the waveform shaping circuit 7 is converted by this circuit 7 into a signal corresponding to the impact of a single bullet, which is introduced as input into the ignition logic circuit 3 and, by way of the output circuit 4, causes a single signal tube to undergo combustion to emit a flare or smoke.

If, after a plurality of bullets in a short burst hit the target to cause one signal tube to operate in the above-described manner, a succeeding burst of machine gun bullets of very slight time difference hits the target, it is again processed as a single bullet impact to cause the secceeding single signal tube to operate to indicate a hit.

Thus, the logic circuit 3 causes a different signal tube to operate every time the waveform shaping circuit 7 generates one sustaining signal as described above. Therefore, a practical and effective bullet pierce indication conforming to the object of marksmanship training can be carried out.

FIG. 6 shows a specific example of a circuit arrangement of FIG. 4. As illustrated, the bullet pierce detection section 1 of this example comprises a parallel circuit 1*a* of 25 resistance wires 13 which parallel circuit forms a feedback resistor of an operational amplifier forming a coefficient multiplier 1*b*. The differentiation circuit 2 is of a type comprising an operational amplifier. The waveform shaping circuit 7 comprises a coefficient multiplier and a retriggerable monostable multivibrator. The ignition logic circuit 3 comprises a shift register SHR receiving at its clock terminal CK the output of the waveform shaping circuit 7. The shift register SHR is initially so set that only the uppermost output is at "1" and the remaining outputs are at "0". Each time a pulse is supplied to the clock terminal CK the output at which "1" is being produced is shifted downward. The output circuit 4 comprises a plurality of amplifiers (only one AMP1 of them is shown) and a plurality of output switching transistors (only one TR1 of them is shown). The emitters of the transistors such as TR1 are respectively connected to ignition heaters (only one IGH1 of them is shown) of the signal tubes.

In the embodiments of the invention described above in conjunction with FIGS. 1 and 4, the bullet pierce detecting elements of the detection section 1 are formed by an electroconductive paint having a high resistivity on a surface of an electrically insulative film, as one example. As one alternative constitution of each bullet pierce detecting element, a good electroconductor and a resistance element may be connected in series. In this case, on the surface on one side of an electrically insulative film 11, a large number of bullet pierce detecting elements, each comprising a good electroconductor and a resistance element in series connection, are secured in mutually parallel and spaced-apart relation with spacing gaps therebetween which are narrower than the diameter of the penetration holes of the bullets to pierce the target. These detecting elements are wired to form parallel connected circuits, and, over these elements, an electrically insulative plastic film is laid thereby to form the detection section 1.

Figure 7:
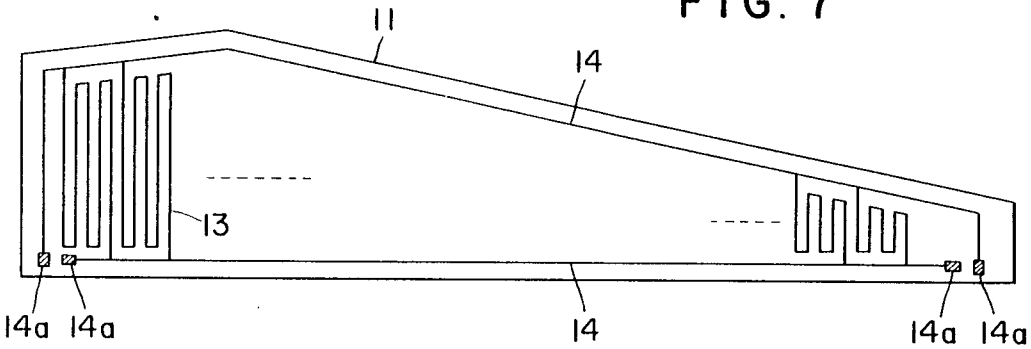
FIG. 7 is a planar view of one example of a pattern of resistance wires and bus conductors in the bullet pierce indication section of the system of the invention.
Figure 8:
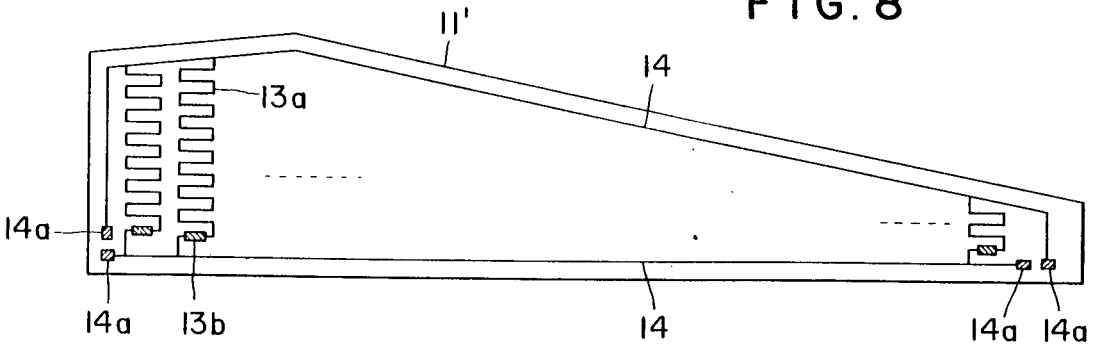
FIG. 8 is a similar planar view of another example of a pattern of wires, respective resistances, and bus conductors in the bullet pierce indication section.

Specific examples of patterns of resistance wires and connection conductors are shown in FIGS. 7 and 8. In the example illustrated in FIG. 7, an insulative film is so formed as to conform to the shape of a wing C of the target and has a length, the for example, of approximately 4 meters. Each bus connector 14 is formed to extend along an edge in the longitudinal direction of the film and is provided at its opposite ends with terminals 14*a* for connection of lead wires by soldering. Each bus conductor 14 is formed by applying as a painted strip of 20-mm width a paint of carbon and silver.

The resistance elements are each formed by applying as a painted strip of the 1.5-mm to 2.0-mm width a carbon paint. As shown in FIG. 7, in the pattern of the resistance elements, the width of the area or region covered by each resistance circuit is substantially the same as the diameter of a bullet hole (e.g., 100 mm), and each resistance element is laid out in its region along a zigzag or shuttling path consisting of a plurality of parallel passes alternately in opposite vertical directions as viewed in FIG. 7. The resistance value of each resistance circuit is of the order of 500 kΩ.

The film 11 bearing the resistance elements 13 and the bus conductors 14 are secured to a wing C (aluminum-alloy skin) by using a pressure-sensitive adhesive or a thermosetting adhesive.

In the example shown in FIG. 8, a sheet of a glass fiber reinforced plastic (GFRP) 11' is used instead of a plastic film. Each resistance circuit 13 comprises a conductor foil 13*a* formed by stamping and shaped in a pattern as shown and a resistance element 13*b* inserted in series with the conductor foil 13*a*. The bus conductors are also of a conductor foil formed by stamping. The resistance circuits may be installed on a wing of a target in a form wherein they are sandwiched between two sheets of a GFRP which are bonded directly to a honeycomb to function doubly as a wing skin.

In each of the above described examples illustrated in FIGS. 7 and 8, terminals 14*a* of the bus conductors 14 are provided at opposite ends of the film or GFRP support and connected to lead wires to other components of the hit-indicating system. By this connection, even if a bus conductor 14 is hit by a bullet and cut at one part thereof, bullet pierce detection will not be affected. Only when the same bus conductor is cut at two parts thereof will there be an effect for the first time. This effect, however, will be limited to failure of bullet pierce detection by the resistance circuits positioned between the two cut parts.

For the indicating elements in the indicating unit 8, instead of the signal tubes 61, 62, . . . , shown in FIGS. 1 and 4, electric light bulbs which are caused to flash by the output signals of the output circuit 4 may be used. In this case, also, the hues of the light bulbs can be made respectively different, whereby the bullet piercing sequence and the number of the remaining light bulbs can be visually determined by the differences in hues of the lit light bulbs.

As described above, according to this invention there is provided a hit indicating system in which a bullet pierce detection section is formed by connecting in parallel connection a large number of bullet pierce detection elements each comprising a resistance member, and variations of the output voltage of this detection section due to variations in the combined resistance value of the detection section are introduced into a differentiation circuit which thereupon produces an output signal in response to which a plurality of indicating elements operate, whereby detection of a large number of instances of bullet piercing by the large number of detection elements can be positively and accurately processed by a single ignition control unit. Thus, a practical hit indicating system which is very light and relatively inexpensive and is suitable for aerial machine-gun training, and which has remarkably high bullet pierce detecting performance and bullet pierce resolving capability is provided by this invention.

What is claimed is:

1. In a target for firing practice to be towed by an aircraft or the like, a hit indicating system comprising:

a bullet pierce detection section installed over parts of the target where bullets are expected to hit and comprising a plurality of parallel connected resistance circuits respectively constituting bullet pierce detecting elements breakable by a piercing bullet;

a differentiation circuit responsive to variations in the combined resistance value of the bullet pierce detection section for generating pulse signals;

an indicating unit comprising a plurality of indicating elements;

a logic circuit for generating outputs for causing said indicating elements to operate sequentially on the basis of the pulse signals of the differentiation circuit;

an electric power source for supplying electric power to the bullet pierce detection section, the differentiation circuit and the logic circuit;

the bullet pierce detection section, the differentiation circuit, the indicating unit, the logic circuit and the power source being installed on board the target;

said bullet pierce detection section includes two bus conductors connecting opposite ends respectively of said resistance circuits in parallel, said bus conductors have opposite ends forming two pairs of terminals connected to said differentiation circuit, whereby bullet pierce detection of the system is unaffected by a single break at one part of the bus conductors, respectively, and bullet pierce detection of the system is affected by a double break at two parts of the bus conductors, respectively, only by failure of the resistance circuits between the double break.

* * * * *